US009044993B2

(12) United States Patent
Conner et al.

(10) Patent No.: US 9,044,993 B2
(45) Date of Patent: Jun. 2, 2015

(54) BINDER WITH REMOVABLE ARTICLE HOLDER

(71) Applicant: Staples The Office Superstore, LLC, Framingham, MA (US)

(72) Inventors: Allison Conner, Brooklyn, NY (US); Gregory Germe, New York, NY (US); Chinawut Paesang, Cumberland, RI (US); Chris Carbone, Plainville, MA (US); Peter Therrien, Rehoboth, MA (US); Casper Crouse, IV, North Attleboro, MA (US); Daniel Reilly, Watertown, MA (US); Michael Kent, Cumberland, RI (US); Margaret Safford, Boston, MA (US)

(73) Assignee: Staples The Office Superstore, LLC, Framingham, MA (US)

( * ) Notice: Subject to any disclaimer, the term of this patent is extended or adjusted under 35 U.S.C. 154(b) by 0 days.

(21) Appl. No.: 13/645,019

(22) Filed: Oct. 4, 2012

(65) Prior Publication Data

US 2013/0136523 A1 May 30, 2013

Related U.S. Application Data

(60) Provisional application No. 61/542,886, filed on Oct. 4, 2011.

(51) Int. Cl.
*B42F 13/00* (2006.01)
*B42F 15/00* (2006.01)
(Continued)

(52) U.S. Cl.
CPC ..... *B42F 13/0073* (2013.01); *Y10T 29/49815* (2015.01); *B42F 15/0064* (2013.01); *B42F 15/0058* (2013.01); *B42F 13/0066* (2013.01); *B42F 15/0052* (2013.01); *B42F 15/06* (2013.01); *B42F 13/40* (2013.01)

(58) Field of Classification Search
CPC ..... B42F 15/0064; B42F 15/0058; B42F 13/0066; B42F 13/0073
USPC ..... 402/75; 281/43; 211/46
See application file for complete search history.

(56) References Cited

U.S. PATENT DOCUMENTS 2,243,535 A 5/1941 Newman
2,253,039 A * 8/1941 Lewis ..... 402/75
(Continued)

FOREIGN PATENT DOCUMENTS

GB 2057358 * 4/1981
GB 2230231 * 10/1990
(Continued)

OTHER PUBLICATIONS

WO9310982 Derwent Abstract.*
(Continued)

*Primary Examiner* — Kyle Grabowski
(74) *Attorney, Agent, or Firm* — Wolf, Greenfield & Sacks, P.C.; Randy J. Pritzker

(57) ABSTRACT

A binder comprising a detachable article holder is described. The article holder comprises hangers that may be extended to detach the article holder from the binder and/or configure the article holder for hanging on support rails. Also described is a method of extending hangers of the article holder to both detach the article holder from the binder shell and configure the article holder for hanging.

25 Claims, 6 Drawing Sheets

(51) Int. Cl.
*B42F 15/06* (2006.01)
*B42F 13/40* (2006.01)

(56) References Cited

U.S. PATENT DOCUMENTS

| | | | | | |
|---|---|---|---|---|---|
| 2,325,155 | A | | 7/1943 | Wedge | |
| 2,888,934 | A | | 6/1959 | Segal | |
| 3,801,175 | A | | 4/1974 | Giulie | |
| 3,865,445 | A | | 2/1975 | Dean et al. | |
| 3,980,360 | A | | 9/1976 | Wright et al. | |
| 3,993,374 | A | | 11/1976 | Schudy et al. | |
| 4,056,296 | A | | 11/1977 | Hedstrom et al. | |
| 4,171,854 | A | | 10/1979 | Hedstrom et al. | |
| 4,208,146 | A | | 6/1980 | Schudy | |
| 4,222,679 | A | | 9/1980 | Luogameno | |
| 4,306,736 | A | | 12/1981 | Cournover et al. | |
| 4,445,799 | A | | 5/1984 | Wright et al. | |
| 4,679,955 | A | | 7/1987 | Marsh | |
| 4,681,474 | A | | 7/1987 | Wiberg | |
| 4,685,821 | A | | 8/1987 | Marsh | |
| 4,765,768 | A | | 8/1988 | Wright | |
| 5,120,149 | A | | 6/1992 | Smith | |
| 5,154,527 | A | | 10/1992 | Blessing | |
| 5,160,209 | A | | 11/1992 | Schuessler | |
| 5,163,768 | A | * | 11/1992 | Salisbury et al. | 402/80 P |
| 5,199,809 | A | * | 4/1993 | Semerjian | 402/4 |
| 5,348,412 | A | | 9/1994 | Fuller | |
| 5,358,125 | A | * | 10/1994 | Blessing | 211/189 |
| 5,622,386 | A | | 4/1997 | Young | |
| 5,642,954 | A | | 7/1997 | Hudspith | |
| 5,680,938 | A | | 10/1997 | Rubinstein | |
| 5,718,530 | A | | 2/1998 | Tibbetts | |
| 5,864,934 | A | | 2/1999 | Young | |
| 5,882,135 | A | | 3/1999 | Ko | |
| 5,924,811 | A | | 7/1999 | To et al. | |
| 5,964,544 | A | | 10/1999 | Ko | |
| 5,975,576 | A | | 11/1999 | Vogel | |
| 5,988,926 | A | | 11/1999 | Kiyomi | |
| 6,019,538 | A | | 2/2000 | Whaley | |
| 6,030,139 | A | | 2/2000 | Ray | |
| 6,203,229 | B1 | | 3/2001 | Coerver | |
| 6,227,746 | B1 | * | 5/2001 | Long et al. | 402/17 |
| 6,419,416 | B1 | | 7/2002 | Tomoda | |
| 6,511,244 | B1 | | 1/2003 | Cohen | |
| 6,626,602 | B1 | * | 9/2003 | Yuen | 281/43 |
| 6,692,029 | B2 | | 2/2004 | Ke | |
| 6,966,108 | B2 | | 11/2005 | Sato et al. | |
| 6,966,721 | B2 | | 11/2005 | Sato et al. | |
| 7,513,708 | B2 | * | 4/2009 | Cheng et al. | 402/75 |
| 7,654,765 | B2 | | 2/2010 | Cheng | |
| 7,665,924 | B2 | | 2/2010 | Hasegawa et al. | |
| 2004/0035736 | A1 | | 2/2004 | Peleman | |
| 2006/0093428 | A1 | * | 5/2006 | Gorin et al. | 402/75 |
| 2006/0226205 | A1 | | 10/2006 | O'Leary et al. | |
| 2007/0196161 | A1 | | 8/2007 | Langerak | |
| 2008/0226385 | A1 | | 9/2008 | Ruble | |

FOREIGN PATENT DOCUMENTS

| | | | | |
|---|---|---|---|---|
| JP | 11151885 | A2 | | 6/1999 |
| WO | WO9310982 | | * | 6/1993 |

OTHER PUBLICATIONS

Avery® Hanging Storage Binder with 1" Gap Free™ Ring 14800, Blue http://www.avery.com/avery/en_us/Products/Binders/More-Binders/Hanging-Storage-Binders_14800.htm?N=0&Ns=&refchannel=c042fd03ab30a110VgnVCM41000002118140aRCRD Accessed Aug. 10, 2011.

Avery Recyclable Ring Binder w/EZ Turn Rings 1-1/12in Capacity http://www.avery.com/avery/en_us/Products/Binders/More-Binders/Recyclable-Budr-1.5in-Red_50007.htm?N=0&Ns=&refchannel=c042fd03ab30a110VgnVCM10000002118140aRCRD Accessed Oct. 4, 2012.

* cited by examiner

BINDER WITH REMOVABLE ARTICLE HOLDER

CROSS-REFERENCE TO RELATED APPLICATION(S)

This application claims the benefit, under 35 U.S.C. §119 (e), of U.S. Provisional Application Ser. No. 61/542,886, entitled "BINDER WITH REMOVABLE ARTICLE HOLDER," filed on Oct. 4, 2011, which is hereby incorporated herein by reference in its entirety.

BACKGROUND

Binders are employed to hold articles, typically loose-leaf papers, documents, and the like. For example, a typical binder includes two covers coupled by a spine, and rings coupled to the spine that are configured to pass through holes in loose-leaf paper. Such binders are often used by students, employees or others for the duration of a class or project. When the class or project is complete, the binder is typically stored if future reference to the articles is desired.

SUMMARY

Storage of binders after the completion of a class or project can consume considerable space, since binders usually have a rigid, bulky shell comprising two covers and a spine. Although an article can be removed from a binder for storage, the benefit of having the article neatly coupled by the binder mechanism, which typically comprises two or more rings that pass through holes in the article, is then lost.

To address some of these limitations of conventional binders, it would be desirable to construct a binder having an article holder, including a binder mechanism, that can be easily detached from the binder shell so that the article held by the article holder can be neatly stored without the binder shell. Further, it would be desirable, according to some implementations, to construct the article holder so that it could be hung in drawers or the like for neat and space-efficient storage.

In view of the foregoing, embodiments described herein relate to article holders that are removable from a binder shell and/or hangable, and binder shells for use with such article holders. The mechanism for making the article holder removable may optionally be associated with the mechanism for making the article holder hangable. In this case, a single action or simultaneous set of actions that detaches the article holder from the binder shell may also cause the article holder to assume a hanging configuration, for example by causing one or more hanging features to extend from the article holder.

One embodiment described herein is directed to a binder comprising a binder shell and an article holder. The binder shell comprises at least first and second panels and an article holder interface coupled to at least one of the first and second panels. The article holder comprises a binder mechanism and a binder shell interface coupled to the binder mechanism, the binder shell interface comprising first and second hangers that are extendable so as to enable the article holder to be suspended from support rails. The article holder interface and the binder shell interface are configured such that the article holder interface is disengaged from the binder shell interface in response to the first and second hangers being extended.

Another embodiment is directed to an article holder attachable to a binder shell, the article holder comprising a binder mechanism and a binder shell interface coupled to the binder mechanism. The binder shell interface comprises a panel comprising first and second openings and first and second hangers coupled to the panel, the first and second hangers being slidable between a retracted position and an extended position. The binder shell interface is configured such the first and second hangers partially obstruct the first and second openings, respectively, when the hangers are in the retracted position, and fully expose the first and second openings, respectively, when the hangers are in the extended position.

A further embodiment is directed to method of detaching an article holder from a binder shell. The binder shell comprises at least first and second panels and an article holder interface coupled to at least one of the first and second panels, the article holder comprises a binder mechanism and a binder shell interface coupled to the binder mechanism, and the binder shell interface comprises first and second hangers that are extendable so as to enable the article holder to be suspended from support rails. The method comprises extending the first and second hangers and thereby disengaging the article holder interface from the binder shell interface.

Another embodiment is directed to a binder comprising a binder shell and an article holder. The binder shell comprises at least first and second panels and an article holder interface coupled to at least one panel. The article holder comprises a binder mechanism and a binder shell interface coupled to the binder mechanism, the binder shell interface comprising first and second movable tabs. The article holder interface and the binder shell interface are configured such that the article holder interface is disengaged from the binder shell interface in response to the first and second tabs being actuated.

A further embodiment is directed to an article holder attachable to a binder shell. The article holder comprises a binder mechanism to hold an article and a panel coupled to the binder mechanism. The panel comprises an exposed surface that faces the binder shell when the article holder is attached to the binder shell. The article holder further comprises first and second hangers coupled to the panel and a label on the exposed surface to identify information concerning the article.

Another embodiment is directed to an article holder attachable to a binder shell. The article holder comprises a binder mechanism to hold an article and a panel coupled to the binder mechanism. The panel comprises an exposed surface that faces the binder shell when the article holder is attached to the binder shell. The article holder further comprises first and second hangers coupled to the panel and a label region on the exposed surface of the panel. The label region is selected from the group consisting of a window configured to receive a label, a sleeve configured to receive a label, a demarcated erasable writing surface, and a demarcated region configured to receive an affixable label.

DETAILED DESCRIPTION

Figure 1:
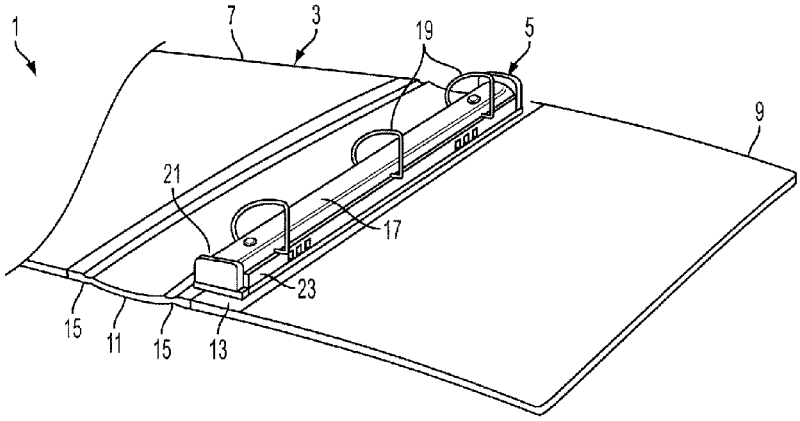
FIG. 1 shows an overview of an exemplary binder comprising a binder shell and a detachable article holder.

FIG. 1 shows an overview of an exemplary binder 1 comprising a binder shell 3 and a detachable article holder 5. The binder shell 3 comprises a front panel 7 and a rear panel 9, which are coupled via hinges 15 to a spine panel 11. According to one exemplary implementation, the configuration of the panels and hinges may be as described in commonly owned U.S. Pat. No. 7,399,136, filed on Jan. 6, 2006 and entitled "Molded Binder," which is hereby incorporated by reference in its entirety.

The article holder 5 comprises a binder mechanism 17, which in turn comprises rings 19 that may be open and closed by actuating tab 21 or a similar feature. According to one exemplary implementation, the configuration of the binder mechanism may be as described in commonly owned U.S. Pat. No. 7,527,449, filed on Dec. 12, 2005 and entitled "Ring Binder Mechanism," which is hereby incorporated by reference in its entirety.

Although rings are a convenient mechanism for holding articles with ring holes, the binder mechanism need not have rings. For example, the binder mechanism may instead include a clamp to releasably secure unbound or bound paper or other items. As another example, the binder mechanism may simply comprise a spine of a pre-bound notebook and the notebook may comprise mating features to couple the notebook to a binder shell. Thus, it may be appreciated that the binder mechanism may, but need not, be configured such that individual papers are selectively removable and replaceable, as with a conventional three-ring binder.

Each of the binder shell 3 and article holder 5 additionally comprises an interface to releasably couple the binder shell and the article holder. In particular, the binder shell 3 comprises an article holder interface 13 and the article holder 5 comprises a binder shell interface 23. The article holder interface 13 comprises features configured to engage with corresponding features on the binder shell interface 23, and thereby couple the binder shell 3 to the article holder 5. When the features and corresponding features disengage, the article holder 5 may be removed from the binder shell 3, as shown in FIG. 2.

Figure 2:
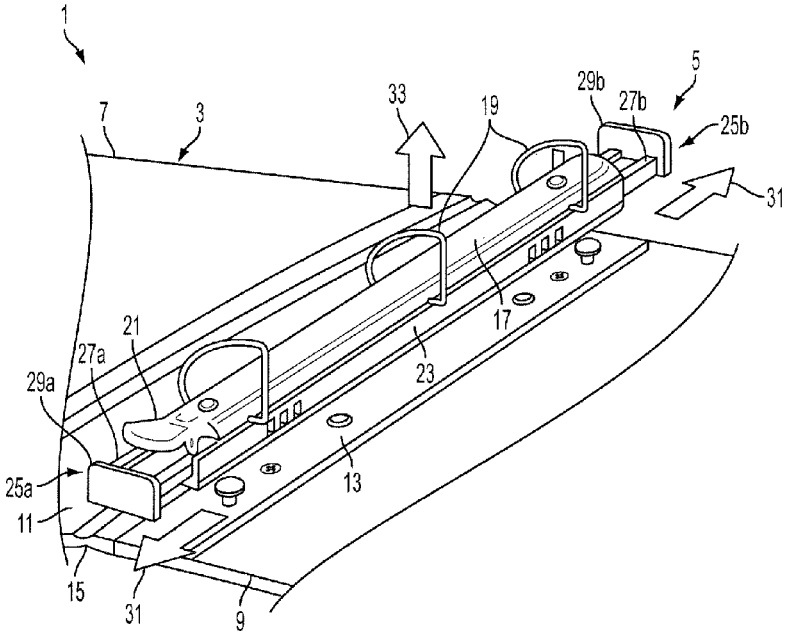
FIG. 2 shows a method of extending slidable hangers of the detachable article holder to detach the article holder from the binder shell and configure the article holder for hanging.

FIG. 2 shows a method of extending slidable hangers to both detach the article holder 5 from the binder shell 3 and configure the article holder for hanging. As shown in FIG. 2, the binder shell interface 23 comprises first and second hangers 25*a*, 25*b*, which in turn comprise respective tabs 27*a*, 27*b* and stops 29*a*, 29*b*. When the hangers 25*a*, 25*b* are extended outward from the center of the binder shell interface 23 in a direction along the length thereof (as indicated by arrows 31), the article holder interface 13 disengages from the binder shell interface 23, allowing the article holder 5 to be removed from the binder shell 3 in an upward direction (as indicated by arrow 33).

Figure 3:
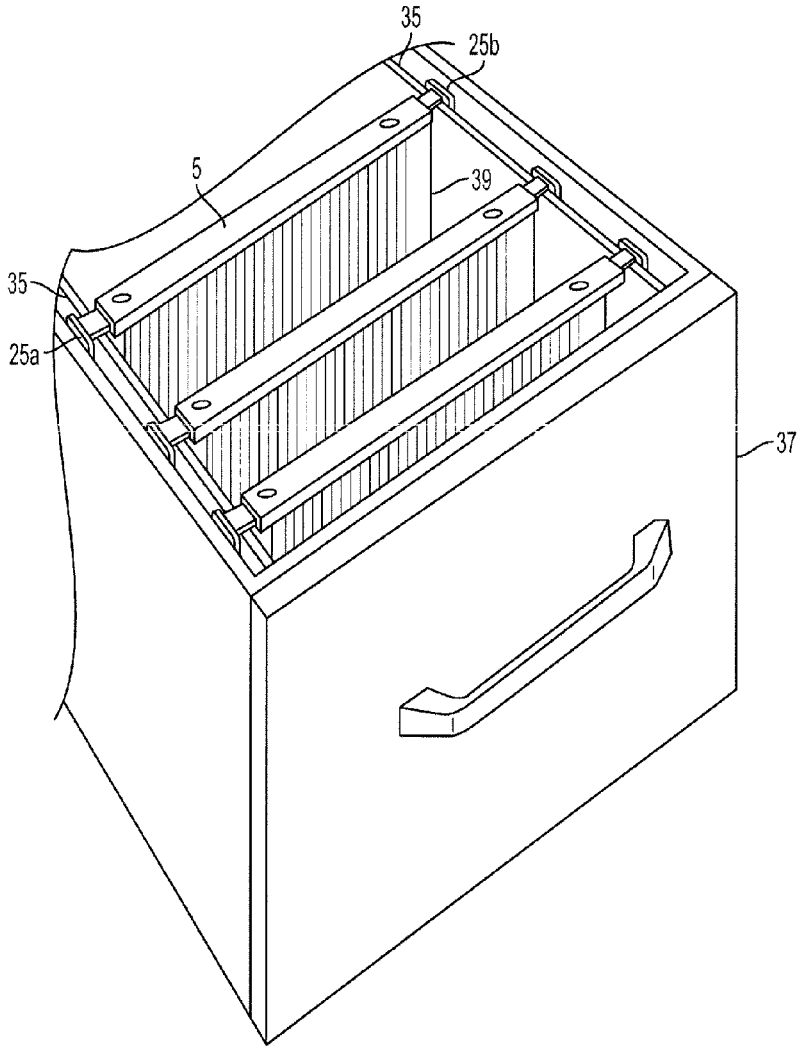
FIG. 3 shows the article holder hung on support rails for storage.

As shown in FIG. 3, the hangers 25*a*, 25*b* may be configured to allow the article holder 5 to be hung on support rails 35 such as those conventionally mounted in a drawer 37 and used to support hanging file folders. In particular, the tabs 27*a*, 27*b* may be configured to rest on the support rails 35 so as to suspend the article holder 5. For example, the tabs 27*a*, 27*b* may have a length in the direction in which they are extendable of at least 0.2 inches, 0.25 inches, or 0.5 inches, so as to accommodate a conventional support rail, and may have a width of at least 0.2 inches, 0.25 inches, or 0.5 inches, so as to provide a stable resting surface. The stops 29*a*, 29*b* may be configured to overhang such support rails 35 so as to restrict movement of the article holder 5 in a direction perpendicular to that of the support rails. For example, the stops 29 may be oriented perpendicular to the direction of the tab and/or may extend below the tabs 27 in the direction of the binder mechanism. The inner surfaces of stops 29*a*, 29*b*, which are adjacent the respective tabs 27*a*, 27*b*, may be separated by a sufficient length to span a conventional distance between the support rails 35. For example, the inner surfaces of stops 29*a*, 29*b* may be separated by a distance that is between 12 inches and 12.5 inches, or approximately 12.25 inches. When the article holder 5 is hung on the support rails 35, an article 39 held by the rings 19 of the article holder may be suspended in a substantially vertical position with respect to a height of the drawer 37.

Figure 4:
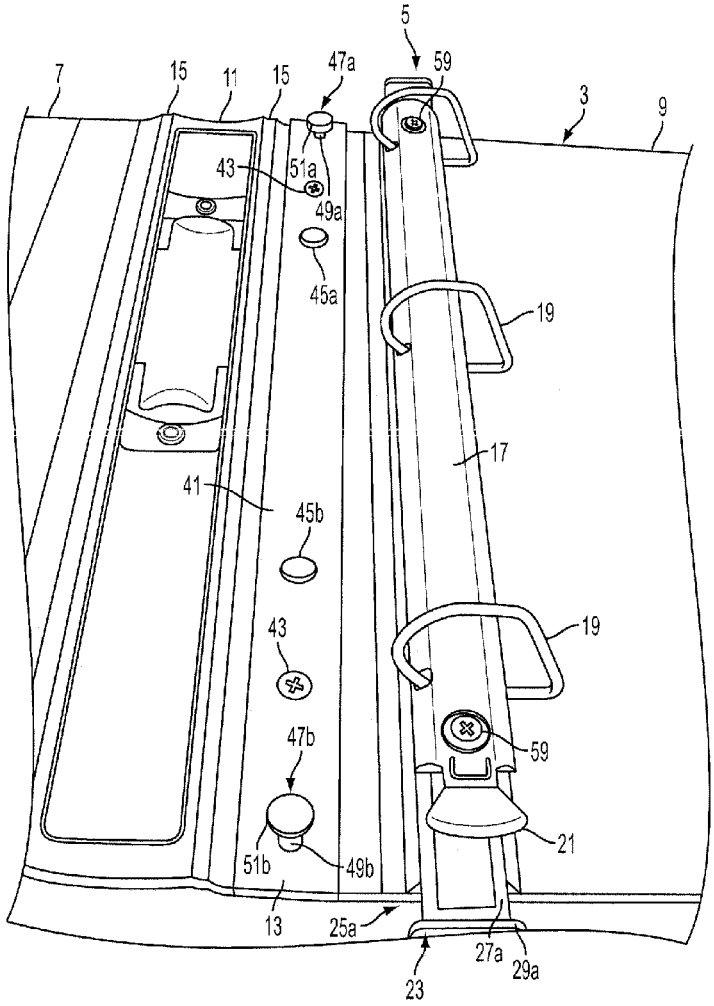
FIG. 4 shows an exemplary implementation of an article holder interface on the binder shell.

Now that an overview of the structure of and methods of using the binder 1 has been provided, details of an exemplary implementation of the article holder interface 13 and the binder shell interface 23 will be described. FIG. 4 shows an exemplary implementation of the article holder interface 13. In the example of FIG. 4, the article holder interface 13 comprises a panel 41 that is attached to the rear panel 9 of the binder shell 3 via screws 43. Protruding from the top surface of the panel 41 are first and second alignment features 45*a*, 45*b*, which have the shape of spherical segments in this exemplary implementation. However, it should be appreciated that these features may have other shapes and configurations or may be eliminated altogether. These features, in cooperation with complementary features on the binder shell interface 23, facilitate alignment of the article holder and binder shell interfaces.

Also protruding from the top surface of the panel 41 are first and second coupling features 47*a*, 47*b*. The first and second coupling features 47*a*, 47*b* respectively comprise first and second post portions 49*a*, 49*b* and first and second head portions 51*a*, 51*b* disposed above the post portions with respect to the panel 41. Thus, the first and second coupling features 47*a*, 47*b* may be considered "mushroom-shaped" and have T-shaped cross-sections. The coupling features 47*a*, 47*b* engage with corresponding features on the binder shell interface 23 to attach the article holder and binder shell interfaces and thereby couple the binder shell to the article holder. As will be described, the article holder and binder shell interfaces may be configured so that the features may be disengaged with a sliding motion that is quick and easy for a user to perform with a single motion of the hands. For example, the features may be disengaged by pulling outward on the hangers 25*a*, 25*b* of the article holder 5.

Although the article holder interface 13 is described above as being coupled to the rear panel 9 of the binder shell 3, such a configuration is merely exemplary. The article holder interface 13 may alternatively be coupled to the front panel 7, the spine panel 11 or any combination of panels. Further, although the article holder interface 13 is described above as being coupled to the binder shell 3 via screws 43, it should be appreciated that other attachment mechanisms may be used. For example, the article holder interface 13 and binder shell 3 may be attached via a hook and loop interface, an adhesive, or welding.

The article holder 13 need not be physically separate from the binder shell 3, as discussed above. According to an alternative implementation, the article holder interface 13 may include one or more features that are integrally molded with the binder shell 3 such that the article holder interface 13 is unitary with the binder shell 3. For example, the first and second coupling features 47*a*, 47*b* may be integrally formed and/or unitary with the binder shell 3. In particular, the first and second coupling features 47*a*, 47*b* may be molded with the binder shell 3 so as to protrude from a surface of one of the panels thereof.

FIG. 4 also shows the article holder 5 in a disengaged or detached position with respect to the binder shell 3. As shown, screws 59 couple the binder mechanism 17 of the article holder 5 to the binder shell interface 23 thereof. However, other attachment mechanisms may be used. For example, the article holder interface 13 and binder shell 3 may be attached via a hook and loop interface, an adhesive, or welding.

The binder shell interface 23 need not be physically separate from the binder mechanism 17, as discussed above. According to an alternative implementation, the binder shell interface 23 may include one or more features that are integrally molded with the binder mechanism 17 such that the binder shell interface 23 is unitary with the binder mechanism 17. For example, the openings 61*a*, 61*b* may be integrally formed and/or unitary with the binder mechanism 17. In particular, the openings 61*a*, 61*b* may formed in the binder mechanism 17 itself.

In the foregoing description, the first and second coupling features 47*a*, 47*b* are part of the article holder interface 13, which may or may not be integral with the binder shell 3, and the openings 61*a*, 61*b* are part of the binder shell interface 23, which may or may not be integral with the binder mechanism 17. However, it should be appreciated that these features may be reversed, such that the first and second coupling features 47*a*, 47*b* are part of the binder shell interface 23, and the openings 61*a*, 61*b* are part of the article holder interface 13. Further, it should be appreciated that the particular mating features are merely exemplary and other features that function the same or differently may be used.

Figure 5:
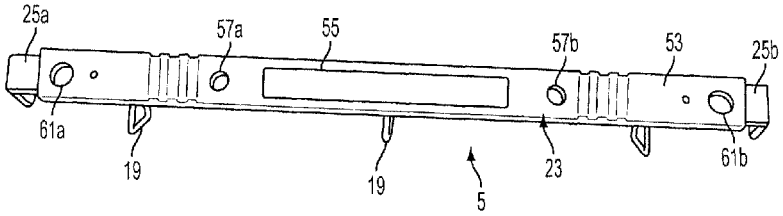
FIGS. 5 and 6 show a bottom view of an exemplary implementation of the article holder having a binder shell interface, with FIG. 5 showing the hangers of the binder shell interface in a disengaged configuration and FIG. 6 showing the hangers in an engaged configuration.
Figure 6:
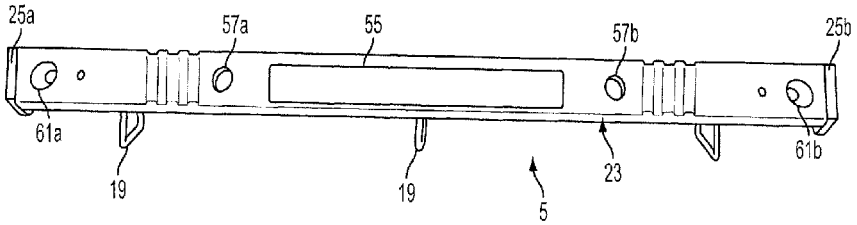

FIGS. 5 and 6 show a bottom view of an exemplary implementation of the article holder 5, and specifically the binder shell interface 23. As shown, the binder shell interface 23 comprises a panel 53 on the underside thereof. First and second alignment features 57*a*, 57*b* comprise recesses in the panel having the shape of spherical segments. By introducing the previously discussed alignment features 45*a*, 45*b* of the article holder interface 13 into the alignment features 57*a*, 57*b* of the binder shell interface 23, the article holder and binder shell interfaces may be aligned in a manner to facilitate engagement of the coupling features of the two interfaces.

When the article holder 5 is hung on support rails 35 or otherwise detached from the binder shell 3, the surface of the panel 53 ordinarily facing the article holder interface 23 is exposed. Therefore, it may be desirable to provide this surface with an aesthetically pleasing appearance. For example, the exposed surface of the panel 53 may comprise a flat, smooth region that occupies the entire space or substantially the entire space between the alignment features 57*a*, 57*b*.

Once the article holder 5 is removed from the binder shell 3, any label or other information concerning the identity of the article provided on the binder shell may no longer be physically associated with the article itself. Thus, it may be helpful to provide a label 55 on the article holder. Although other locations are possible, it may be desirable to display the label 55 on the exposed surface of the panel 53 so that it may be easily read when the article holder 5 is hung on support rails 35. For example, the label 55 may be displayed in the region of the exposed surface of the panel 53 between the alignment features 57*a*, 57*b*, and may identify the subject matter of or other information concerning an article being held by the article holder 5. A number of implementations are possible for the label. For example, the label 55 may have an adhesive backing and may be affixed to the panel 53, e.g., in a demarcated region and/or a region having a different texture. As another example, the label 55 may be introduced into an at least partially transparent sleeve, which holds and protects the label. As a further example, a transparent window region may be provided on the panel 53 and a clamp or other mechanism may hold the label 55 in place adjacent the window. As yet another example, the panel 53 may be provided with an erasable label region in which identification information may be written. The erasable label region may comprise a different material than the material of the panel 53 and/or may be demarcated.

The panel 53 comprises first and second round openings 61*a*, 61*b* at the ends thereof. These openings 61*a*, 61*b* are configured to receive the first and second coupling features 47*a*, 47*b* of the article holder interface 13. In particular, the openings 61*a*, 61*b* are sized and shaped to accommodate the head portions 51*a*, 51*b* of the coupling features 47*a*, 47*b*. Together with first and second hangers 25*a*, 25*b*, the openings 61*a*, 61*b* function to engage and disengage the binder shell interface 23 from the article holder interface 13.

FIG. 5 shows the hangers 25*a*, 25*b* of the binder shell interface 23 in a disengaged configuration, while FIG. 6 shows the hangers 25*a*, 25*b* in an engaged configuration. When the hangers 25*a*, 25*b* are in the extended configuration of FIG. 25, the openings 61*a*, 61*b* are unobstructed, such that the head portions 51*a*, 51*b* of the coupling features 47*a*, 47*b* may pass through the openings in either direction. Thus, in this configuration, the binder shell interface 23 may be both positioned on and removed from the article holder interface 13. Once the binder shell interface 23 is positioned on the article holder interface 13 with the alignment features 45*a*, 45*b* of the article holder interface 13 received within the alignment features 57*a*, 57*b* of the binder shell interface 23, the hangers 25*a*, 25*b* may be slid inward so that the binder shell interface 23 assumes the engaged configuration of FIG. 6. In this case, it may be observed that the hangers 25*a*, 25*b* partially obstruct the respective openings 61*a*, 61*b* so as to prevent the head portions 51*a*, 51*b* of the coupling features 47*a*, 47*b* from passing through the openings. Thus, the head portions 51*a*, 51*b* are engaged with the combination of hangers 25*a*, 25*b* and openings 61*a*, 61*b* and function to attach the article holder 5 to the binder shell 3.

Figure 7:
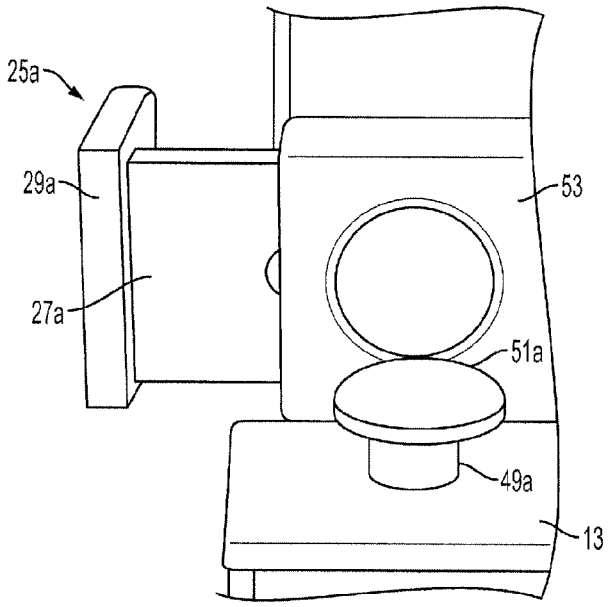
FIGS. 7 and 8 respectively show enlarged views of the hangers of the binder shell interface in the disengaged configuration of FIG. 5 and the engaged configuration of FIG. 6.
Figure 8:
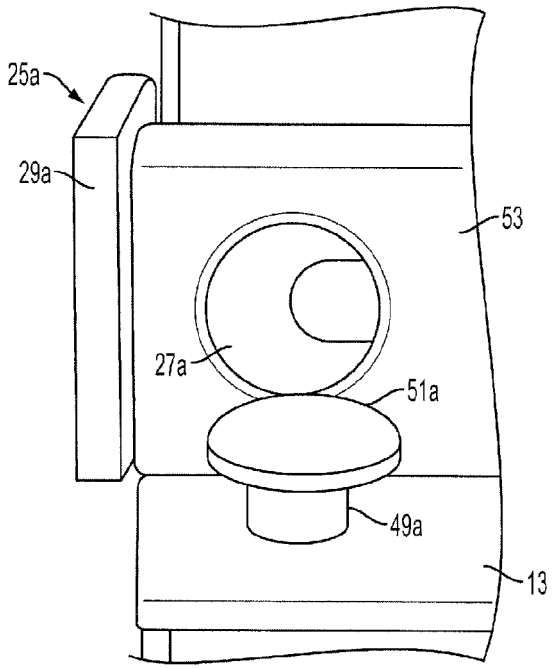

FIGS. 7 and 8 show enlarged views of the hangers 25*a* of the binder shell interface 23 in the disengaged configuration of FIG. 5 and the engaged configuration of FIG. 6, respectively. FIGS. 7 and 8 also show the coupling feature 47*a* of the article holder interface 13, and illustrate that the head portion 51*a* thereof is sized and shaped to be received within the opening 61*a*. As shown, however, the size and shape of the head portion 51*a* may closely approximate the size and shape opening 61*a*.

Figure 9:
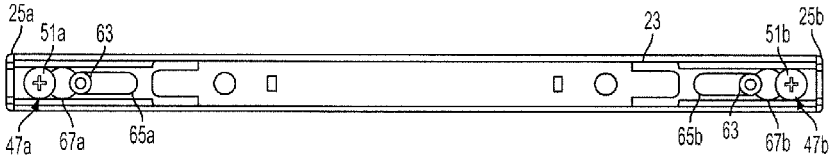
FIGS. 9 and 10 respectively show top down and perspective views of the article holder interface and the binder shell interface when they are coupled to each other and the hangers are in the engaged configuration.
Figure 10:
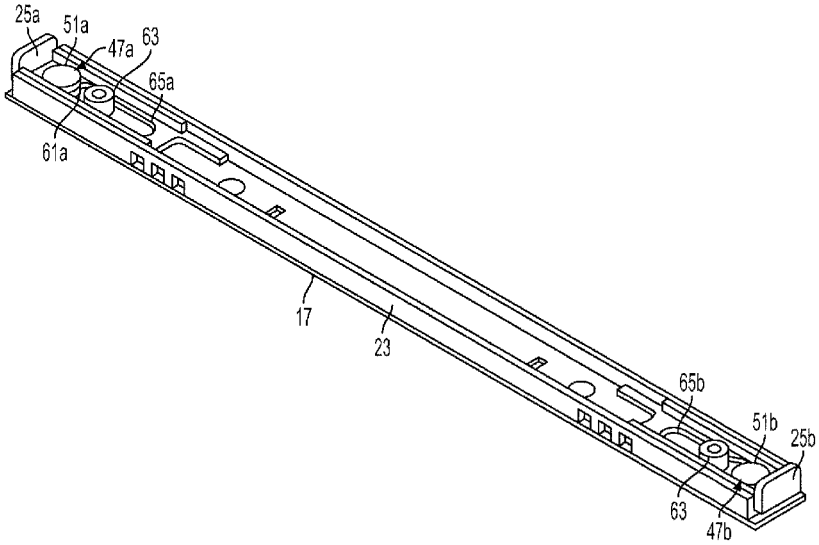

FIGS. 9 and 10 show top down and perspective views, respectively, of the article holder interface 13 and the binder shell interface 23 when they are coupled to each other and the hangers 25*a*, 25*b* are in the engaged configuration. It may be appreciated that in this configuration, the hangers 25*a*, 25*b* partially overlap and thereby obstruct the openings 61*a*, 61*b*, which are positioned directly below the head portions 51*a*, 51*b* of the coupling features 47*a*, 47*b*. Since the binder mechanism is not shown in FIGS. 7 and 8, openings 63, which receive the screws 59 that couple the binder mechanism 17 to the binder shell interface 23, are exposed. The configuration of the hangers 25*a*, 25*b* may also be seen. As shown, the hangers 25*a*, 25*b* comprise respective slots 65*a*, 65*b* in which the coupling features 47*a*, 47*b* and openings 63 are disposed. To configure the hangers 25*a*, 25*b* in the disengaged configuration, the hangers 25*a*, 25*b* are slid longitudinally away from the coupling features 47*a*, 47*b* until circular regions 67*a*, 67*b* of the slots 65*a*, 65*b* are aligned with the head portions 51*a*, 51*b* of the coupling features 47*a*, 47*b*. These circular regions 67*a*, 67*b* have a diameter that is at least slightly larger than that of the head portions 51*a*, 51*b* so as to allow the head portions to pass through the circular regions when the binder shell interface 23 is removed from the article holder interface 13.

An exemplary implementation of a binder having an article holder that is detachable from the binder shell with a simple hand motion has been described. It should be appreciated that the binder described is merely exemplary, and other implementations are possible. For example, although the hangers 25*a*, 25*b* are described as serving a hanging function, the hangers need not be used for this purpose. In particular, the hangers or other similar slidable features may be used simply to detach the article holder from the binder shell.

Further, it should be appreciated that the implementation of the hangers 25*a*, 25*b* is merely exemplary. Although the hangers 25*a*, 25*b* are described as being slid manually by a user, the hangers 25*a*, 25*b* may alternatively be spring-loaded and caused to extend via the actuation of a release button. As another example, although the hangers 25*a*, 25*b* are described as being slidable to extend the hangers from a retracted to an extended position, other motions are possible. According to an alternative implementation, the hangers 25*a*, 25*b* may be rotated from a retracted position to an extended position. In particular, the hangers 25*a*, 25*b* may be rotated about an axis that extends along a width of the article holder 5 (e.g., in a direction parallel to rings 19), such that the hangers are aligned with an axis extending the length of the article holder 5 as they are rotated in a vertical direction. Alternatively, the hangers 25*a*, 25*b* may be rotated about an axis that extends vertically with respect to the article holder 5 (e.g., in a direction parallel to the posts of screws 59), such that the hangers swing initially away from and then toward an axis extending the length of the article holder 5 as they are rotated.

According to yet another implementation, the hangers 25*a*, 26*b* are pre-extended such that a user need not extend the hangers for hanging. For example, the hangers 25*a*, 26*b* may be fixed in an extended position. Although such a configuration may result in a larger overall footprint for the article holder 6, other advantages such a simplicity of manufacturing and/or durability may be realized.

The described article holder interface 13 and binder shell interface 23 are likewise merely exemplary. For example, the interfaces need not be unitary. Separate devices or components may cooperate to perform the functions of either interface. Further, although a pair of coupling features 47*a*, 47*b* of the article holder interface 13 are described, one or more than two such coupling features may alternatively be used and the mating features on the binder shell interface 23 may have a corresponding configuration.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

What is claimed is:

1. A binder comprising:

a binder shell comprising:

at least first and second panels; and an article holder interface coupled to at least one of the first and second panels; and an article holder comprising:

a binder mechanism; and a binder shell interface coupled to the binder mechanism, the binder shell interface comprising first and second hangers that are extendable;

wherein the article holder interface and the binder shell interface are configured such that the article holder interface is disengaged from the binder shell interface in response to the first and second hangers being extended in opposite directions;

wherein the first and second hangers are structured such that the article holder may be suspended from support rails by the hangers when the article holder interface is disengaged from the binder shell interface.

2. The binder of claim 1, wherein:

the first and second hangers respectively comprise first and second tabs and first and second stops; and each stop extends below each tab in the direction of the binder mechanism.

3. The binder of claim 2, wherein:

the first and second stops respectively comprise first and second inner surfaces adjacent the first and second tabs, respectively; and a distance between the first and second inner surfaces is between 12 inches and 12.5 inches.

4. The binder of claim 3, wherein:

the distance between the first and second inner surfaces is approximately 12.25 inches.

5. The binder of claim 1, wherein:

the at least first and second panels comprise front and rear panels;

the front and rear panels are coupled via a spine; and the article holder interface is coupled to the rear panel.

6. The binder of claim 1, wherein the binder mechanism comprises a plurality of rings.

7. The binder of claim 1, wherein the binder mechanism comprises a spine.

8. An article holder attachable to a binder shell, the article holder comprising:

a binder mechanism; and a binder shell interface coupled to the binder mechanism, the binder shell interface comprising:

a panel comprising first and second openings; and first and second hangers coupled to the panel, the first and second hangers being slidable between a retracted position and in opposing directions to an extended position;

wherein the binder shell interface is configured such the first and second hangers partially obstruct the first and second openings, respectively, when the hangers are in the retracted position, and fully expose the first and second openings, respectively, when the hangers are in the extended position;

wherein the first and second hangers are structured such that the article holder may be suspended from support rails by the hangers when the article holder is disengaged from the binder shell interface.

9. The article holder of claim 8, wherein:

the first and second hangers respectively comprise first and second tabs and first and second stops; and each stop extends below each tab in the direction of the binder mechanism.

10. The article holder of claim 9, wherein:

the first and second stops respectively comprise first and second inner surfaces adjacent the first and second tabs, respectively; and a distance between the first and second inner surfaces is between 12 inches and 12.5 inches.

11. The article holder of claim 10, wherein:

the distance between the first and second inner surfaces is approximately 12.25 inches.

12. The article holder of claim 8, wherein the binder mechanism comprises a plurality of rings.

13. The article holder of claim 8, wherein the binder mechanism comprises a spine.

14. A binder comprising:

a binder shell comprising:

at least first and second panels; and an article holder interface coupled to at least one panel; and an article holder comprising:

a binder mechanism; and a binder shell interface coupled to the binder mechanism, the binder shell interface comprising first and second movable tabs;

wherein the article holder interface and the binder shell interface are configured such that the article holder interface is disengaged from the binder shell interface in response to the first and second tabs being actuated; and wherein the first and second tabs are structured such that the article holder may be suspended from support rails by the tabs when the article holder interface is disengaged from the binder shell interface.

15. The binder of claim 14, wherein the binder mechanism comprises a plurality of rings.

16. The binder of claim 14, wherein the binder mechanism comprises a spine.

17. An article holder attachable to a binder shell, the article holder comprising:

a binder mechanism to hold an article;

the binder mechanism, having a panel comprising an exposed inner surface that faces the binder shell when the article holder is attached to the binder shell;

first and second hangers coupled to the panel; and a label on the exposed inner surface to identify information concerning the article;

wherein the first and second hangers are structured such that the article holder may be suspended from support rails by the hangers when the article holder is disengaged from the binder shell.

18. The article holder of claim 17, wherein the binder mechanism comprises a plurality of rings.

19. The article holder of claim 17, wherein the binder mechanism comprises a spine.

20. The article holder of claim 17, wherein the article holder is configured to be coupled to the binder shell.

21. An article holder attachable to a binder shell, the article holder comprising:

a binder mechanism to hold an article;

binder mechanism having a panel comprising an exposed inner surface that faces the binder shell when the article holder is attached to the binder shell;

first and second hangers coupled to the panel; and a label region on the exposed inner surface of the panel, the label region selected from the group consisting of: a window configured to receive a label, a sleeve configured to receive a label, a demarcated erasable writing surface, and a demarcated region configured to receive an affixable label;

wherein the first and second hangers are structured such that the article holder may be suspended from support rails by the hangers when the article holder is disengaged from the binder shell.

22. The article holder of claim 21, wherein the binder mechanism comprises a plurality of rings.

23. The article holder of claim 21, wherein the binder mechanism comprises a spine.

24. The article holder of claim 21, wherein the article holder is configured to be coupled to the binder shell.

25. A method of detaching an article holder from a binder shell, wherein the binder shell comprises at least first and second panels and an article holder interface coupled to at least one of the first and second panels, the article holder comprises a binder mechanism and a binder shell interface coupled to the binder mechanism, and the binder shell interface comprises first and second hangers that are extendable so as to enable the article holder to be suspended from support rails, the method comprising:

extending the first and second hangers in opposite directions to thereby disengaging the article holder interface from the binder shell interface; and after extending the first and second hangers, positioning the first and second hangers on support rails to suspend the article holder from the support rails.

* * * * *